US005841228A

United States Patent [19]

Cha et al.

[11] Patent Number: 5,841,228

[45] **Date of Patent: *Nov. 24, 1998**

[54] GETTER ASSEMBLY WITH STIFFENED GETTER WAND AND CRT

[75] Inventors: Chin Y. Cha, Bloomfield; Shridhar V. Iyer, Ann Arbor; Thomas W. Penird, Ypsilanti, all of Mich.

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 666,050

[22] Filed: Jun. 19, 1996

[51] Int. Cl.[6] ..... H01J 29/94

[52] U.S. Cl. ..... 313/481; 313/558

[58] Field of Search ..... 313/481, 549, 313/558, 547, 553, 560

[56] References Cited

U.S. PATENT DOCUMENTS 3,996,488 12/1976 Zucchinelli ..... 313/481

4,006,381 2/1977 Thall ..... 313/481

4,486,686 12/1984 della Porta ..... 313/481

FOREIGN PATENT DOCUMENTS 60-220535A 11/1985 Japan ..... H01J 29/50

*Primary Examiner*—Sandra L. O'Shea

*Assistant Examiner*—Michael Day

*Attorney, Agent, or Firm*—Norman N. Spain

[57] ABSTRACT

A cathode ray tube (CRT) has a getter attachment wand with a trough-shape along a substantial portion of its length, imparting an increased stiffness to the wand to maintain the wand in close proximity to the inside surface of the CRT envelope, thereby avoiding clipping of the electron beam on its way to the screen. An optimal curvature of the wand strikes a balance between the desired stiffness and the ease with which the wand can be resistance welded to the top cup of the electron gun assembly.

7 Claims, 6 Drawing Sheets

GETTER ASSEMBLY WITH STIFFENED GETTER WAND AND CRT

BACKGROUND OF THE INVENTION

This invention relates to cathode ray tube display devices (CRTs) for use in televisions, computer monitors and allied display applications, and more specifically relates to the getter assembly mounted inside the envelope of the CRT.

The CRT produces a display by the excitation of cathodoluminescent phosphor particles in the screen disposed on the inside of the display window of the CRT. Such excitation is achieved by scanning the screen with one or more cathode rays (electron beams) from the electron gun assembly in the neck of the sealed envelope of the CRT.

The CRT relies for its successful operation upon the maintenance of a vacuum environment within its sealed envelope. While the envelope is evacuated and sealed during its manufacture, the vacuum environment can degrade over the life of the CRT, principally by the outgassing of the various components which are sealed inside the envelope. In order to prevent or at least lessen such degradation, CRTs include getters, compounds which are sealed inside the envelope and later flashed (vaporized) to deposit getter materials on adjacent surfaces, where they absorb free molecules.

The getter compounds are placed in an open container or cup, and the cup is located on the inside surface of the envelope. After evacuation and sealing of the envelope, the getter compounds are flashed by RF heating from a source located outside of the envelope adjacent the cup.

Conventionally, the getter container is maintained securely in place by a wand, a strip of spring material which extends from the top of the electron gun assembly along the wall of the envelope. While in the past the proximity of the wand to the wall prevented interference of the wand with the path of the electron beam to the screen, newer CRT designs, and in particular, larger screen sizes (from 27 V up to 40 V, "V" conventionally indicating the diagonal dimension of the screen in inches), narrow diameter necks and greater beam deflection angles, have given rise to the problem of "getter shadow", i.e., beam clipping by the wand, caused by the wand protruding outward into the beam path. Rejection of CRTs due to such clipping or getter shadow are particularly costly for the manufacturer, since they occur only after completion of the manufacturing process.

OBJECTS AND SUMMARY OF THE INVENTION

Accordingly, it is an object of the invention to provide an improved getter assembly for a CRT which does not clip the electron beam.

It is another object of the invention to provide such an improved getter assembly which holds the getter container securely in place without rattling.

It is another object of the invention to provide such an improved getter assembly which is both convenient and economical to use in the manufacturing process.

It is yet another object of the invention to provide a CRT incorporating such an improved getter assembly.

In accordance with the invention, a getter assembly and a cathode ray tube (CRT) incorporating such an assembly, have a getter container and an elongated strip-shaped wand, one end of which is attached to the getter container, and the other end of which is attached to the electron gun assembly. The wand has a spring bias which extends along the inside surface of the funnel and holds the getter container in contact with this surface. The wand also has a curvature in its width direction that imparts a trough-shape to the wand and increases the spring bias of the wand along a substantial portion of the length of the wand. By this structure, clipping of the electron beam directed to the screen is avoided while the getter container is maintained securely in place without rattling.

In accordance with a preferred embodiment of the invention, an optimal curvature of the wand strikes a balance between the desired stiffness and the ease with which the wand can be resistance welded to the top cup of the electron gun assembly.

DESCRIPTION OF THE PREFERRED EMBODIMENTS

Figure 1:
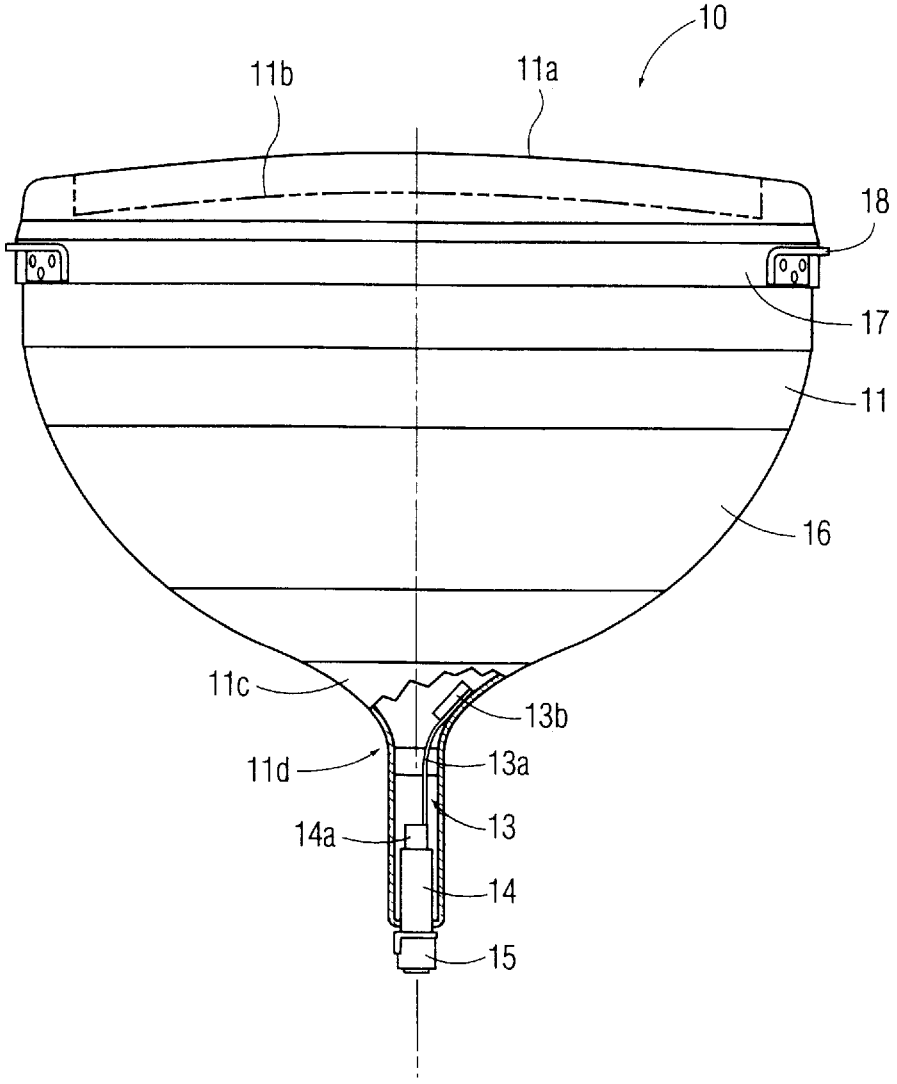
FIG. 1 PRIOR ART
FIG. 1 is a side elevation view, partly cut away, of a prior art 27 V narrow neck (NN) CRT display device of the type used for color television, showing the electron gun and getter assemblies in the neck and funnel of the CRT.

Referring now to FIG. 1, there is shown a side elevation view, partly cut away, of a prior art 27 V NN CRT display device 10 of the type used for color television, including a sealed glass envelope 11, composed of a front display window 11*a*, having a cathodoluminescent screen 11*b* disposed on the inner surface thereof, a funnel portion 11*c*, and a neck 11*d*. Mounted inside the neck is an electron gun assembly 14, having a top cup 14*a*. Top cup 14*a* supports a getter assembly 13, including an elongated metal wand 13*a* attached to the cup 14*a*, and getter cup 13*b* attached to wand 13*a*. Power to the CRT is supplied via connector pins, not shown, at 15. External conductive coating 16, and implosion protecting band 17, having mounting brackets 18, are also shown in FIG. 1.

The wand 13*a* is fabricated from a spring material such as Inconel, to have a resting (unloaded) curvature along its length greater than that shown in FIG. 1, for example, about 45 mm, and is attached to the top cup so that the wand curves away from the axis of the electron gun assembly. In the CRT manufacturing process, the electron gun-getter assembly is inserted into the CRT through the open end of the neck, which has a smaller diameter (e.g., 28 mm for NN) than the reach of the getter assembly. During insertion, the wand is thus straightened somewhat as the getter container bears against the inner surface of the envelope. In this partially flexed condition, the inherent spring bias of the wand maintains the getter container firmly in place. The gun assembly is then aligned, after which the envelope is evacuated and sealed by sealing the end of the gun assembly to the end of the neck.

Figure 2:
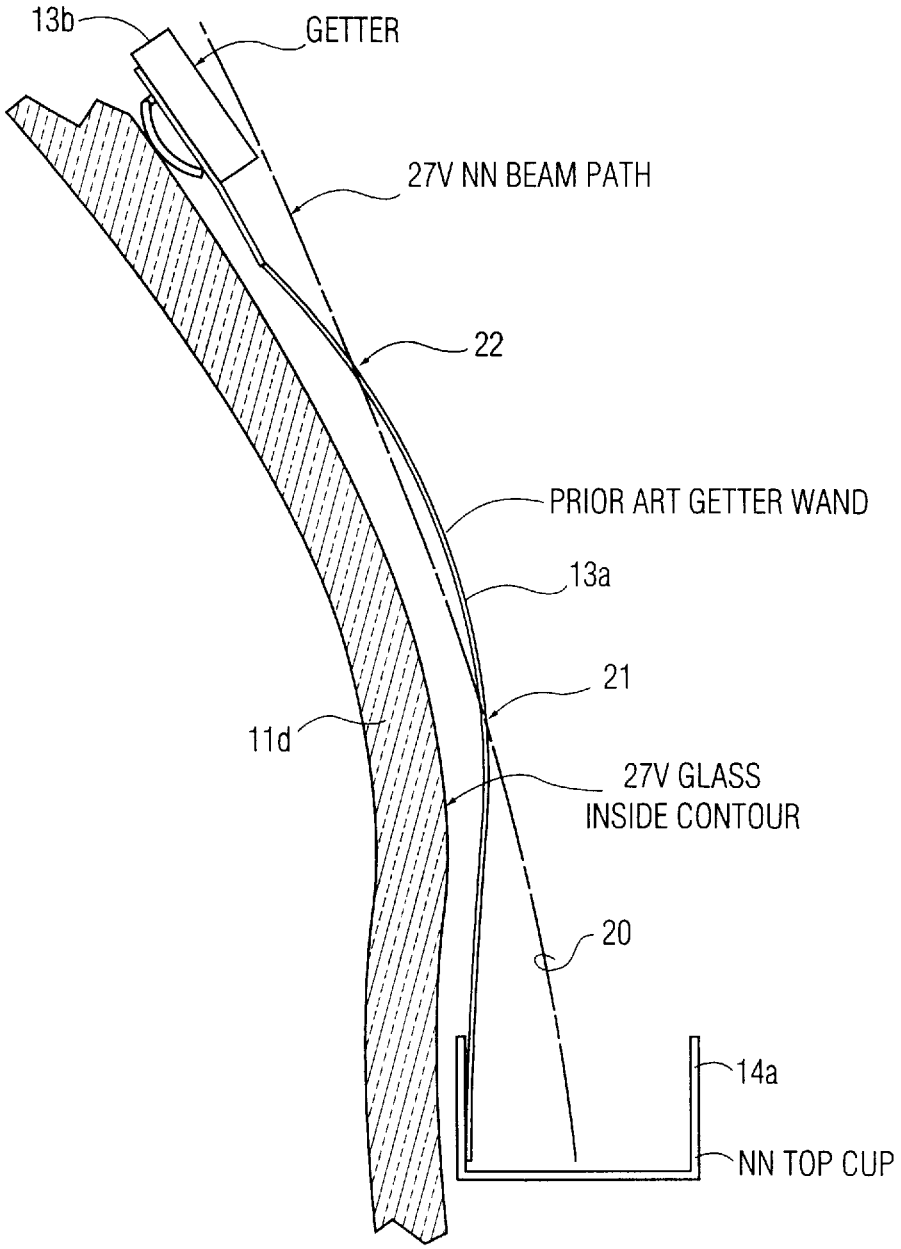
FIG. 2 PRIOR ART
FIG. 2 is a detailed view of a portion of the CRT of FIG. 1, showing the position of the getter wand with respect to the path of a deflected electron beam.

Referring now to FIG. 2, a detailed view of a portion of the CRT 10 of FIG. 1, there is shown the position of the getter wand 13*a* with respect to the path 20 of a deflected electron beam from gun assembly 14. Path 20 represents a position of extreme deflection, at or near the position at which a horizontal (line) scan of the screen begins. As may be seen, the getter wand 13*a* bulges outwardly into the beam path 20 between points 21 and 22, to clip or shadow the beam.

Figure 3A:
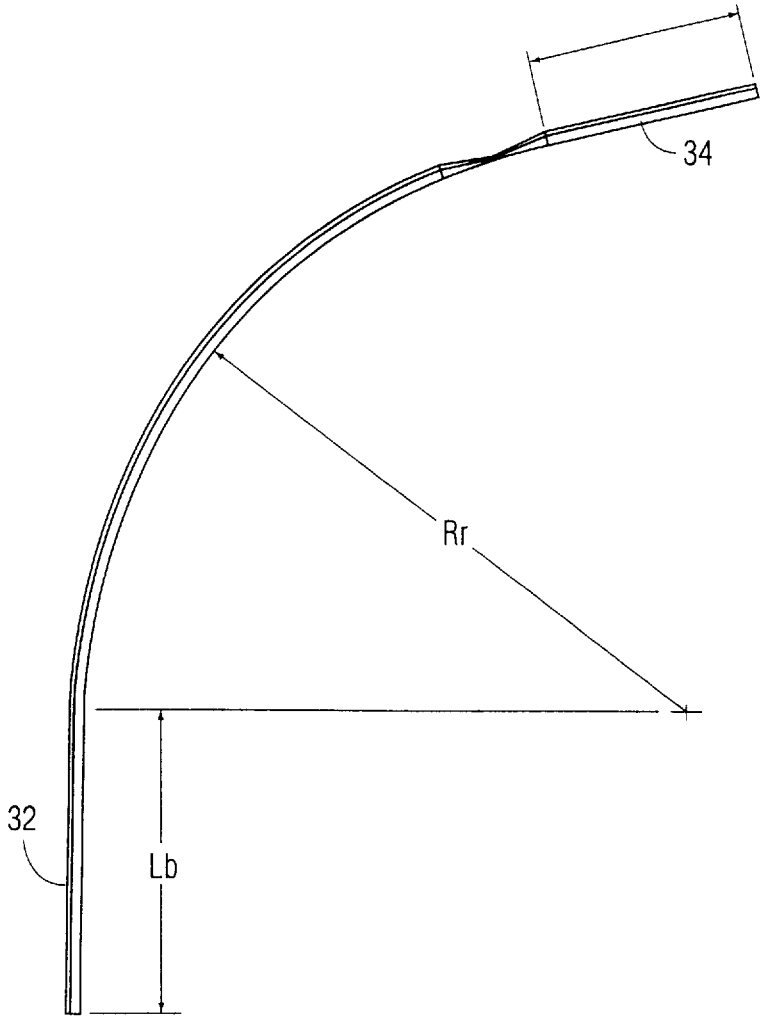
FIGS. 3(*a*), (*b*) and (*c*) are side, end and perspective views, respectively, of one embodiment of a wand of the getter assembly of the invention, showing the trough-like shape of the stiffened portion of the wand.
Figure 3B:
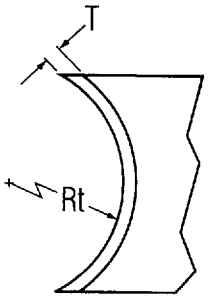
Figure 3C:
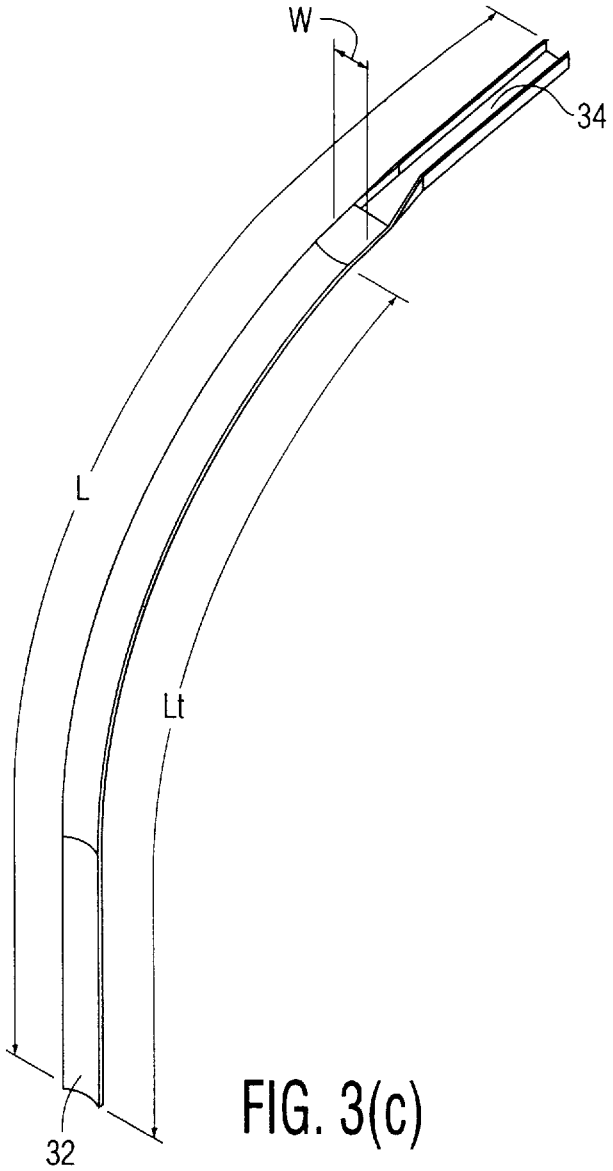
Figure 4:
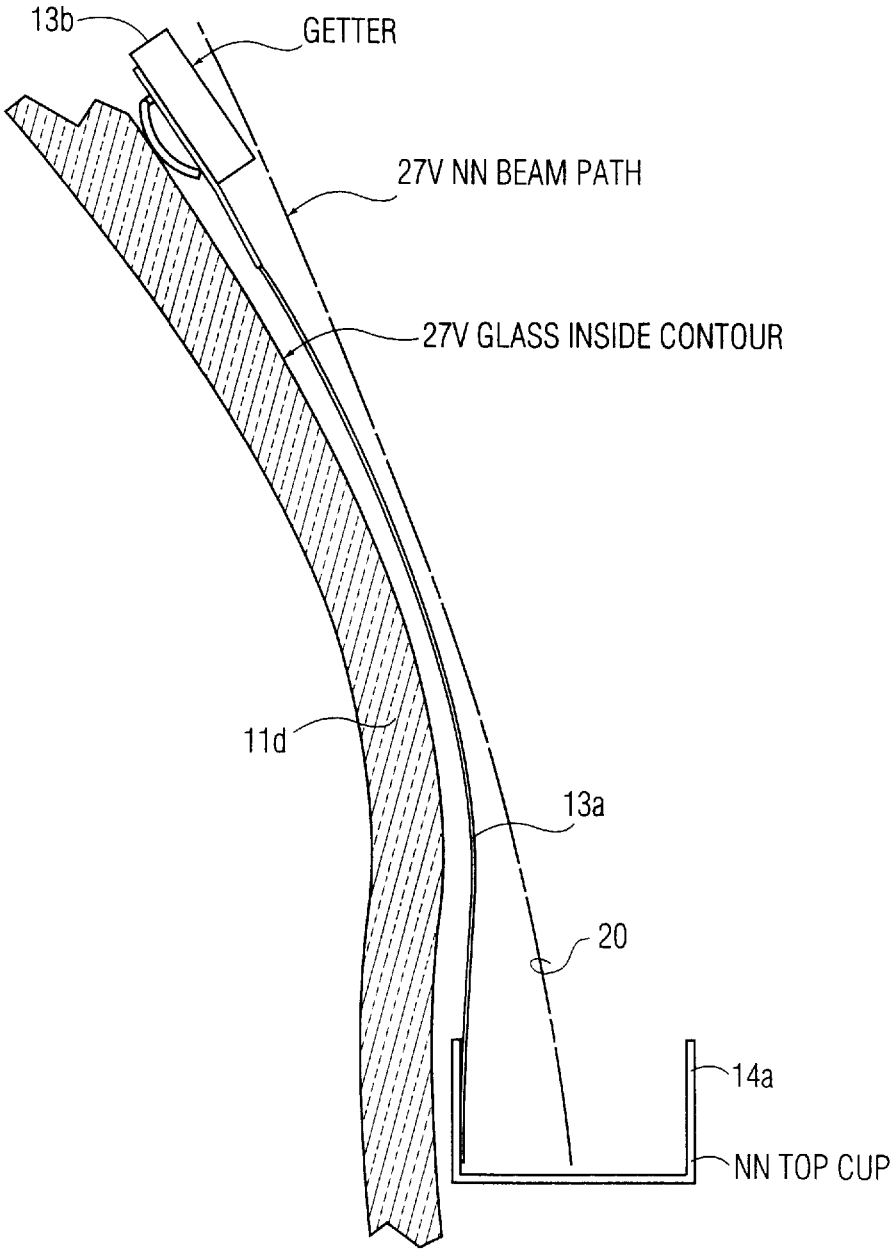
FIG. 4 is a detailed view similar to that of FIG. 2, except that the getter wand of the prior art has been replaced by a getter wand of the invention.

In accordance with the invention, the getter wand is given a curvature across its width along a substantial portion of its length, as may be seen from FIG. 3(*c*), a perspective view of one embodiment of the wand, resulting in a trough-like shape which stiffens the wand. This curvature must be sufficient to substantially prevent the wand from bulging outward into the electron beam path when fully deflected, as shown in FIG. 4 (FIG. 3 of disclosure).

Figure 5A:
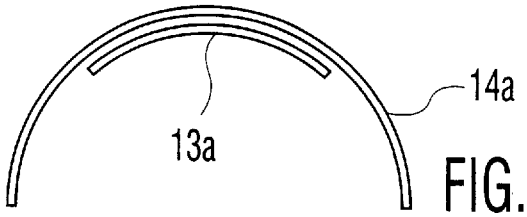
FIGS. 5(*a*), (*b*) and (*c*) are plan views of getter wands having three different curvatures, in position for welding to the top cup of an electron gun assembly.
Figure 5B:
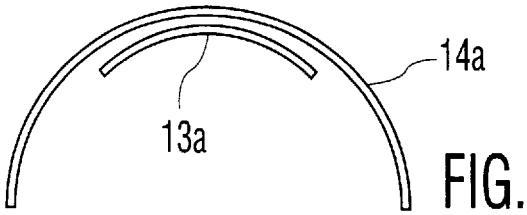
Figure 5C:
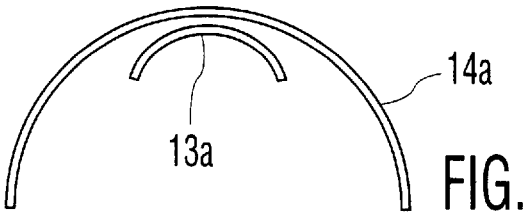

Preferably, the curvature is also such as to enable the ready attachment of the wand to the top cup of the electron gun assembly by resistance welding. FIGS. 5(*a*), (*b*) and (*c*) are top views of portion of the sidewall of the top cup of an electron gun assembly, with getter wands having three different curvatures, in position for welding to the top cup. In FIG. 5(*a*), the radius of the wand is about the same as that of the top cup. In this case, the large area of contact between the wand and cup makes welding difficult due to the current density over the larger area of contact is smaller. In FIG. 5(*c*), the radius of the wand is much smaller than that of the top cup. In this case, the small area of contact between the wand and cup makes positioning of the wand prior to welding difficult.

Based on the above considerations, as well as upon the required stiffness needed to substantially avoid shadowing of the electron beam, the radius of the wand should be between 35 and 55 percent of the radius of the top cup, as represented by FIG. 5(*b*). For a NN CRT in which the inside radius of the top cup is 10.8 mm, the radius of the wand should be in the range of about 3.56 to 4.5 mm.

FIGS. 3(*a*), (*b*) and (*c*), side elevation, end and perspective views, respectively, show the various features of one embodiment of a wand suitable for use in the invention. The wand is fabricated from a strip of spring material such as Inconel, having an overall length, width and thickness, L, W and T, respectively. The strip is formed to have a curvature across its width W, which defines a trough along the length Lt. The trough has a radius of curvature Rt. The strip is formed to have a curvature along its length L, beginning above an uncurved base portion 32 having a length Lb. This curvature extends approximately to the end of the trough, and is defined by a resting (unloaded) radius Rr. The upper end of the wand has a channel portion 34 designed to attach to a getter container, not shown.

For the getter assembly of a 27 V NN CRT having an electron gun assembly top cup inside radius of 10.8 mm, exemplary dimensions (mm) for a wand of Inconel having a Rockwell C hardness of 27 or greater, are as follows:

| | |
|---|---|
| length L | 97.66 +– 0.51 |
| width W | 3.96 +– 0.081 |
| thickness T | 0.25 +– 0.013 |
| length of trough Lt | 73.25 +– 0.50 |
| radius of trough Rt | 3.56 +– 0.38 |
| length of base Lb | 22.86 +– 0.50 |
| resting radius Rr | 44.45 +– 6.35 |

The invention has been described in terms of a limited number of embodiments. Other embodiments and variations of embodiments will become apparent to those skilled in the art, and are intended to be encompassed within the scope of the amended claims.

What we claim as our invention is:

1. A cathode ray tube comprising:

a sealed envelope comprising a display window, a funnel and a neck:

a catholumenescent screen disposed on the inside surface of the display window;

an electron gun assembly mounted in the neck for directing at least one electron beam onto the screen; the electron gun assembly including a cup-shaped element at the top thereof, and a getter assembly comprising a getter container and an elongated strip-shaped wand, one end of which wand is attached to the getter container, and the other end of which wand is attached to the cup-shaped element of the electron gun assembly, the wand having a spring bias extending along the inside surface of the wand and holding the getter container in contact with said surface;

characterized in that the wand has a curvature on the width direction in the range of from about 35 to 55 percent of the radius of curvature of the cup-shaped element, said curvature imparting a trough-shape to the wand, and increasing the spring bias of the wand, along a substantial portion of the length of the wand.

2. The cathode ray tube of claim 1 in which the radius of curvature of the wand is within the range of about 3.18 to 4.5 mm.

3. The cathode ray tube of claim 1 in which the curvature extends from the end of the wand attached to the electron gun assembly for about seventy five percent of the length of the wand.

4. The cathode ray tube of claim 1 in which the cup has a inside radius of curvature of about 10.8 mm.

5. The cathode ray tube of claim 1 in which the wand is attached to the cup by means of a resistance weld.

6. A getter assembly for a cathode ray tube having a sealed envelope comprising a display window, a funnel and a neck, a cathodluminescent screen disposed on the inside surface of the display window and an electron gun assembly, including a cup-shaped element at the top thereof, mounted in the neck for directing at least one electron beam onto the screen; said assembly comprising a getter container and an elongated strip-shaped wand, one end of which wand is attached to the getter container, and the other end of which wand is attached to the cup-shaped element of the electron gun assembly, the wand having a spring bias extending along the inside surface of the funnel and holding the getter container in contact with said surface; characterized in that the wand has a curvature in its width direction in the range of from about 35 to 55 percent of the radius of curvature of the cup-shaped element, said curvature imparting a trough-shape to the wand, and increasing the spring bias of the wand, along a substantial portion of the length of the rod, which spring bias is such that the wand extends along an inside surface of the funnel and holds the getter container in contact with said inside surface.

7. The getter assembly of claim 6 in which the curvature extends from the end of the wand attached to the electron gun assembly along about seventy five percent of the length of the wand.

* * * * *